United States Patent [19]

Tanner et al.

[11] 4,334,469

[45] Jun. 15, 1982

[54] CAN CRUSHER

[76] Inventors: Douglas Tanner, c/o George Spector, 3615 Woolworth Bldg., 233 Broadway; George Spector, 3615 Woolworth Bldg., 233 Broadway, both of New York, N.Y. 10007

[21] Appl. No.: 154,902

[22] Filed: May 30, 1980

[51] Int. Cl.[3] ..... B30B 9/04; B30B 9/32

[52] U.S. Cl. ..... 100/110; 100/255; 100/288; 100/295; 100/902; 248/206 R

[58] Field of Search ..... 100/DIG. 2, 288, 295, 100/240, 53, 110, 116, 125, 98 R, 255; 248/206 R

[56] References Cited

U.S. PATENT DOCUMENTS

| | | | |
|---|---|---|---|
| 200,487 | 2/1878 | Stears | 100/125 |
| 737,521 | 8/1903 | Stopple | 100/255 X |
| 2,234,098 | 3/1941 | Wells | 100/DIG. 2 |
| 2,306,884 | 12/1942 | Jakovicz | 100/125 |
| 2,581,294 | 1/1952 | Read | 100/288 X |
| 2,638,957 | 5/1953 | Danielson | 100/DIG. 2 |

FOREIGN PATENT DOCUMENTS

| | | | |
|---|---|---|---|
| 1144139 | 10/1957 | France | 100/288 |
| 857578 | 12/1960 | United Kingdom | 100/DIG. 2 |

*Primary Examiner*—Billy J. Wilhite

[57] ABSTRACT

An apparatus for crushing tin cans for convenient disposal, the apparatus including an enclosure fitted with a door for placing cans therein, a crank operated pressure plate inside the enclosure for pressing downward against the cans and a stepped conical seat upon which cans are placed so to not slip during crushing operation.

5 Claims, 6 Drawing Figures

Fig. 1
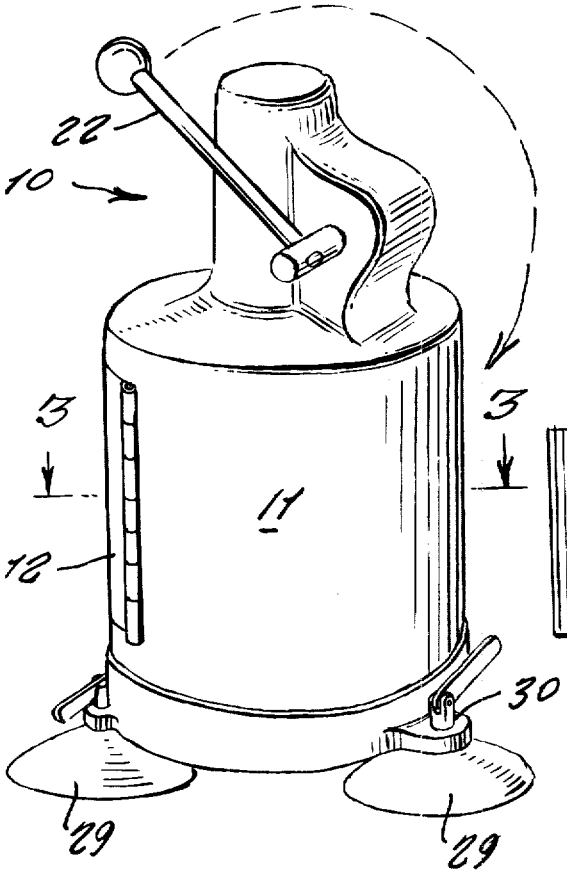
Fig. 2
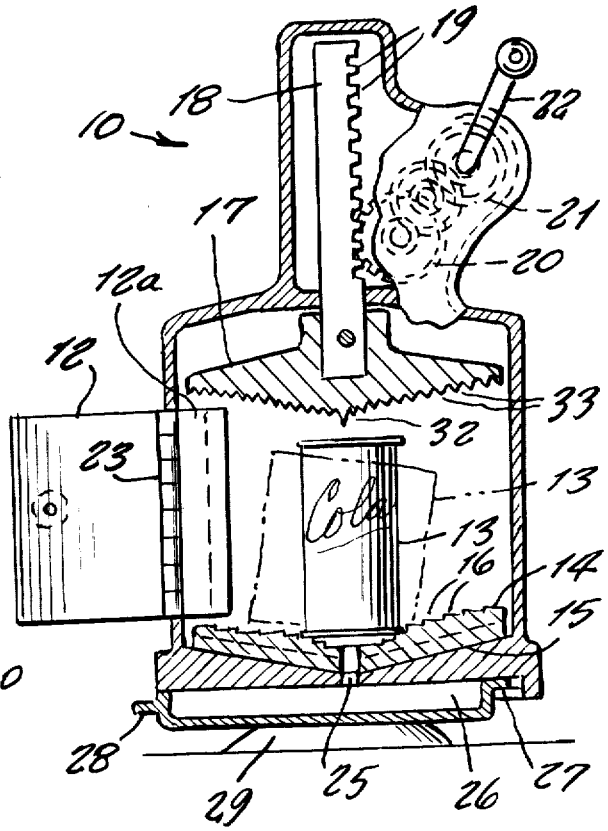
Fig. 4
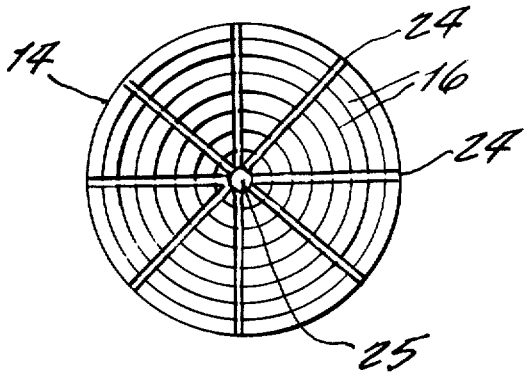
Fig. 3
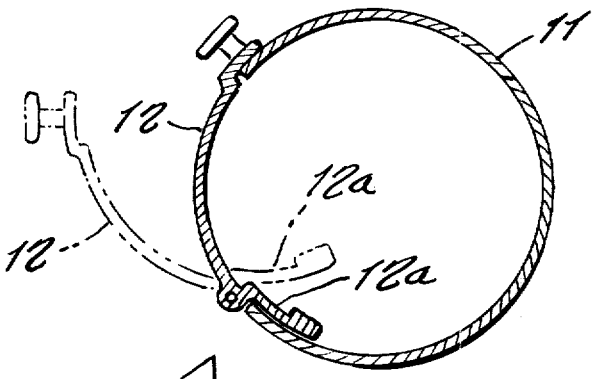
Fig. 5
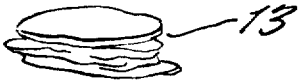
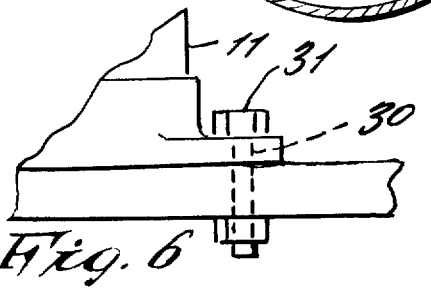
Fig. 6

CAN CRUSHER

This invention relates generally to can crushing devices.

It is well known that many persons these days submit certain of their refuse articles such as old newspapers, empty glass bottles and metal tin cans to recycling collection centers, so that these articles can then be recycled again. It is noted that donators are requested that such tin cans be crushed flat, so that they take up a minimum space in handling.

Accordingly, it is a principal object of the present invention to provide a can crusher which is of a size that is suitable for use in a home, so that home residents can easily and quickly crush metal cans that are to be disposed.

Another object accordingly is to provide a can crusher, which by crushing emptied food tin cans, reduces the size of a refuse in the house so that the refuse need not be carried out as frequently as it does not fill a refuse receptacle as fast.

FIG. 1 is a perspective view of the invention.

FIG. 2 is a side cross sectional view of the invention and shown including a stepped conical seat on which a can sits so to not slip sideways while being crushed, the plunger including a correspondingly conical face that is toothed for the same purpose.

FIG. 3 is a cross sectional view on line 3—3 of FIG. 1, and showing how the open door blocks the path of the plunger.

FIG. 4 is a top view of the can pad or seat.

FIG. 5 shows a can crushed by the device.

FIG. 6 is a fragmentary side view showing a bolt mounting.

Referring now to the drawing in greater detail, the reference numeral 10 represents a can crusher according to the present invention, wherein there is a hollow main housing 11 having a hinged side door 12 so to allow placing an empty tin can 13 therein.

A removal plate 14 is placable upon a floor 15 of the housing, the plate being downwardly concaved conically toward its center by means of concentric rows of steps 16.

A vertically movable pressure plate 17 is affixed to a shaft 18 having a row of teeth 19 that engage a gear 20 of a gear mechanism 21 operated by a hand crank 22.

It is to be noted that the door hinge 23 is located intermediate opposite vertical side edges of the door so that a portion 12*a* of the door swings inside the housing, when the door is outwardly pivoted open, the portion 12*a* thus serving as a stop that prevents the pressure plate from being downwardly plunged while the door is yet open, thus preventing a person to crush their hand or fingers inside the housing.

The plate 14 includes radially extending troughs 24 on its upper side so that any liquids left in the can prior to crushing will run downward to a central drain hole 25 through the plate and drip downward therefrom upon a shallow tray 26 therebeneath and which is slidable in opposite side and end grooves 27, so that the tray can be slided out from under the housing in order to be emptied of liquid periodically. A pull handle 28 is formed on a front side of the tray.

As shown in FIGS. 1 and 2, the housing may be provided with suction cups 29 near its bottom so as to rest upon any smooth surface without slipping.

Alternately the suction cups can be removed and the holes 30, normally supporting the suction cups, can be fitted with bolts 31 for screwing into any rough supporting surface, as shown in FIG. 6.

The underside of the pressure plate is downwardly conical to a central apex having a downward punch 32 for piercing a can top. Concentric rows of teeth 33 around the punch, (together with steps 16), serve to retain a can from slipping out from under the pressure plate during a crushing action.

The can may be rested upright as shown by solid lines in FIG. 2 so the can is axially flattened as shown in FIG. 5. Alternately the can be tilted, as shown by phantom lines in FIG. 2, so that the can is flattened toward its side.

Plate 14 is removable out of the housing through the doorway so that the housing interior may be cleaned.

While various changes may be made in the detail construction, it is understood that such changes will be within the spirit and scope of the present invention as is defined by the appended claims.

What is claimed:

1. A can crusher, comprising in combination, a hollow housing, a side door on said housing, a conical base inside said housing and upon which a tin can may be rested, and a vertically movable pressure plate correspondingly conical mounted in said housing and movable from an upper position above said door to a lower position below said door including means for moving said plate located above said plate, in further combination with a door hinge located between opposite vertical edges of said door providing an inwardly disposed door portion which functions as a stop for said plate when the door is opened, said base having stepped surfaces with drainage holes therethrough.

2. The combination as set forth in claim 1 in further combination with a slidable tray on a bottom of said housing below said base to catch any liquid dripping from said cans during a crushing operation.

3. A can crusher as in claim 2, wherein said housing includes an upper chamber enclosing said means which comprise a rack secured to said plate and a pinion having an external crank handle for rotation of said pinion.

4. A can crusher as in claim 1 wherein said housing includes means for securing said crusher to a support by suction cups.

5. A can crusher as in claim 2 wherein said door portion snugly abutts the housing when closed and the hinge is adjacent the edge of the opening.

* * * * *